US009353529B2

(12) United States Patent
Richmeier

(10) Patent No.: US 9,353,529 B2
(45) Date of Patent: May 31, 2016

(54) MODULAR AWNING ASSEMBLY

(71) Applicant: Douglas W. Richmeier, Great Bend, KS (US)

(72) Inventor: Douglas W. Richmeier, Great Bend, KS (US)

( * ) Notice: Subject to any disclaimer, the term of this patent is extended or adjusted under 35 U.S.C. 154(b) by 0 days.

(21) Appl. No.: 14/470,272

(22) Filed: Aug. 27, 2014

(65) Prior Publication Data

US 2014/0360678 A1 Dec. 11, 2014

(51) Int. Cl.
*E04F 10/02* (2006.01)
*E04F 10/06* (2006.01)

(52) U.S. Cl.
CPC ..... *E04F 10/02* (2013.01); *E04F 10/0603* (2013.01); *E04F 10/0607* (2013.01); *E04F 10/0637* (2013.01)

(58) Field of Classification Search
CPC ..... E04F 10/02; E04F 10/04
USPC ..... 160/59, 65, 66, 67, 47, 84.06, 22; 135/88.1
See application file for complete search history.

(56) References Cited

U.S. PATENT DOCUMENTS

| | | | | | |
|---|---|---|---|---|---|
| 744,971 | A | * | 11/1903 | Monroe | 160/58.1 |
| 924,951 | A | * | 6/1909 | Winberg | 160/70 |
| 1,620,958 | A | * | 3/1927 | Girton et al. | 160/65 |
| 1,742,437 | A | * | 1/1930 | Davenport | 160/65 |
| 2,805,711 | A | * | 9/1957 | Mehl | 160/76 |
| 3,789,903 | A | * | 2/1974 | Clark et al. | 135/88.12 |
| 3,834,400 | A | * | 9/1974 | Sattler | 135/88.12 |
| 3,952,758 | A | | 4/1976 | Addison et al. | |
| 4,269,531 | A | * | 5/1981 | Brolin | 403/97 |
| 4,665,964 | A | * | 5/1987 | Zommers | 160/84.06 |
| 5,579,797 | A | | 12/1996 | Rogers | |
| 5,794,679 | A | * | 8/1998 | Williams et al. | 160/46 |
| 5,803,104 | A | | 9/1998 | Pollen | |
| 6,125,905 | A | * | 10/2000 | Woodside et al. | 160/67 |
| 6,439,150 | B1 | | 8/2002 | Murphy et al. | |
| 7,395,774 | B2 | | 7/2008 | Borges et al. | |
| 7,401,569 | B2 | | 7/2008 | Jones | |
| 7,490,574 | B2 | | 2/2009 | Shearer et al. | |
| 7,685,960 | B1 | | 3/2010 | Carusello et al. | |
| 7,895,964 | B2 | | 3/2011 | Russikoff | |
| 7,950,342 | B2 | | 5/2011 | Russikoff | |
| 8,056,495 | B2 | | 11/2011 | Lemons | |
| 8,205,571 | B1 | | 6/2012 | Rondeau et al. | |
| 2006/0201635 | A1 | | 9/2006 | Ridley et al. | |
| 2010/0252207 | A1 | * | 10/2010 | Westgarth | 160/45 |
| 2011/0290170 | A1 | | 12/2011 | Russikoff | |

FOREIGN PATENT DOCUMENTS

| | | |
|---|---|---|
| EP | 0628667 | 12/1994 |
| FR | 2674813 | 4/1999 |
| GB | 1468290 | 3/1977 |

* cited by examiner

*Primary Examiner* — David Purol
(74) *Attorney, Agent, or Firm* — Kenneth H. Jack; Davis & Jack, L.L.C.

(57) ABSTRACT

A modular awning assembly incorporating a flexible sheet; a shade frame fitted for supporting the flexible sheet, the shade frame having left and right arms and having a cross beam spanning between the left and right arms; sheet fasteners interconnecting the flexible sheet and the shade frame; left and right vertical support columns; shade attaching joints pivotally connecting the shade frame's left and right arms to the left and right vertical support columns; and column mounting brackets operatively connected to the left and right vertical support columns, the column mounting brackets being adapted for moveably attaching the left and right vertical support columns to a structure selected from the group consisting of vehicles, recreational vehicle side walls, vehicle hitches, boats, boat deck rails, building side walls, and fences.

6 Claims, 4 Drawing Sheets

MODULAR AWNING ASSEMBLY

CLAIM OF PRIORITY FROM PREVIOUSLY FILED PROVISIONAL PATENT APPLICATION

Figure 1:
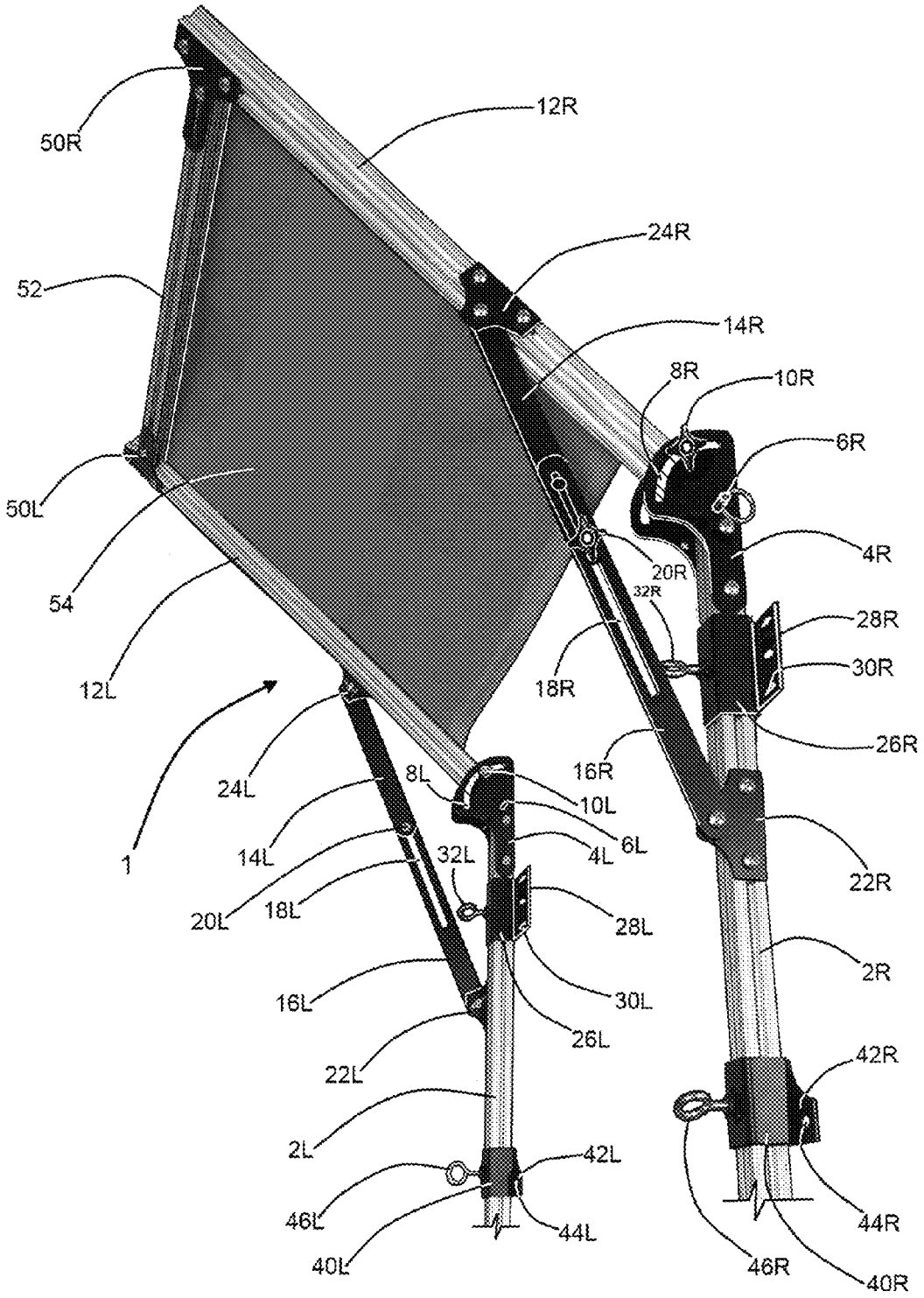

This non-provisional patent application claims the benefit of and priority from U.S. provisional patent application No. 61/872,442 filed Aug. 30, 2013. The inventors disclosed in and the applicant of said provisional application are one and the same as those of the instant application. The Specification and drawings of said provisional application are substantially identical to those of the instant application.

FIELD OF THE INVENTION

This invention relates to shades and awnings. More particularly, this invention relates to shades and awnings which are adapted for flexible sheet articulating, positioning, and repositioning, and for awning uses in multiple configurations.

BACKGROUND OF THE INVENTION

Shades or awnings are commonly known to be adapted for structural mounting upon a single article, vehicle, or surface, and are normally adapted only for alternative retraction and extension.

The instant inventive modular awning assembly overcomes common awning disadvantages and limitations by providing for and by structurally facilitating the awning's attachments to, removals from, and reattachments to variously configured structures, surfaces, and vehicles by incorporating structural adaptations for multiple articulating positionings and repositionings of base support components, and by facilitating a "reefing" function which alternatively extends and retracts a flexible sheet component.

BRIEF SUMMARY OF THE INVENTION

A first structural component of the instant inventive modular awning assembly comprises left and right vertical support columns. Each column among the left and right vertical support columns preferably comprises a length of extruded aluminum bar stock whose cross-sectional profile presents a plurality of longitudinally extending slide/lock channels.

A further structural component of the instant inventive modular awning assembly comprises a shade frame which is preferably adapted for supporting and deploying a flexible sheet of the type which is capable of screening sun rays and/or blocking precipitation. In a preferred embodiment, the invention's shade frame component comprises left and right arms in combination with a crossmember which spans between and rigidly interconnects the arms' distal ends. Similarly with the vertical support columns' configurations, the shade frame's left and right arms and crossmember preferably comprise extruded aluminum bar stock which presents slide/lock channels.

A further structural component of the instant inventive awning assembly comprises first attaching means which are adapted for respectively pivotally interconnecting the proximal ends of the shade frame's left and right arms with the upper ends of the left and right vertical support columns. In a preferred embodiment, the first attaching means comprise left and right pin, eye, and clevis joints which facilitate selectively angled cantilevered positions of the shade frame with respect to the support columns. Other commonly known joints capable of selective angular positioning of attached components such as pivoting plate joints, ball pivot joints, pin and arcuately arrayed eyes joints are considered to fall within the scope of the invention.

Further structural components of the instant inventive awning assembly comprise at least a first, and preferably a pair of or left and right triangulating braces, each such brace spanning between the shade frame and one of the columns among the left and right support columns. In a preferred embodiment, the triangulating braces are adapted for releasably locking and for telescopingly moving between extended and retracted positions, such braces thereby further securing the shade frame and flexible sheet at the various selected angular orientations.

A further structural component of the instant inventive awning assembly comprises second attaching means which are adapted for securely attaching the left and right support columns and the shade and shade frame they carry to various differently configured structures such as boat deck rails, fences, building sidewalls, recreational vehicle sidewalls, and vehicle hitches. In a preferred embodiment, the second attaching means comprise a plurality of mounting plates adapted for engagement with bolt fasteners, screw fasteners, or strap fasteners.

A further structural component of the instant inventive awning assembly comprises sheet reefing means which operatively interconnect the flexible sheet and the shade frame. In a preferred embodiment, and where the left and right frame members include the preferred longitudinally extending slide/lock channels, the sheet reefing means comprise a continuous loop cord and pulleys assembly.

Accordingly, objects of the instant invention include the provision of a modular awning assembly which incorporate components and structures as described above, and which arranges those components and structures with respect to each other in manners described above for achievement of the functions and benefits as described above.

Other and further objects, benefits, and advantages of the present invention will become known to those skilled in the art upon review of the Detailed Description which follows, and upon review of the appended drawings.

BRIEF DESCRIPTION OF THE DRAWINGS (The drawings are partially photographic in nature. Notwithstanding, the drawings are sufficiently explanatory of their subject matters to facilitate examination of the application. Accordingly, the Applicant respectfully requests that any requirement that black and white line drawings be substituted be held in abeyance, and that any such requirement be imposed only after examination of the application.)

FIG. 1 is a perspective view of a preferred embodiment of the instant inventive modular awning assembly.

Figure 2:
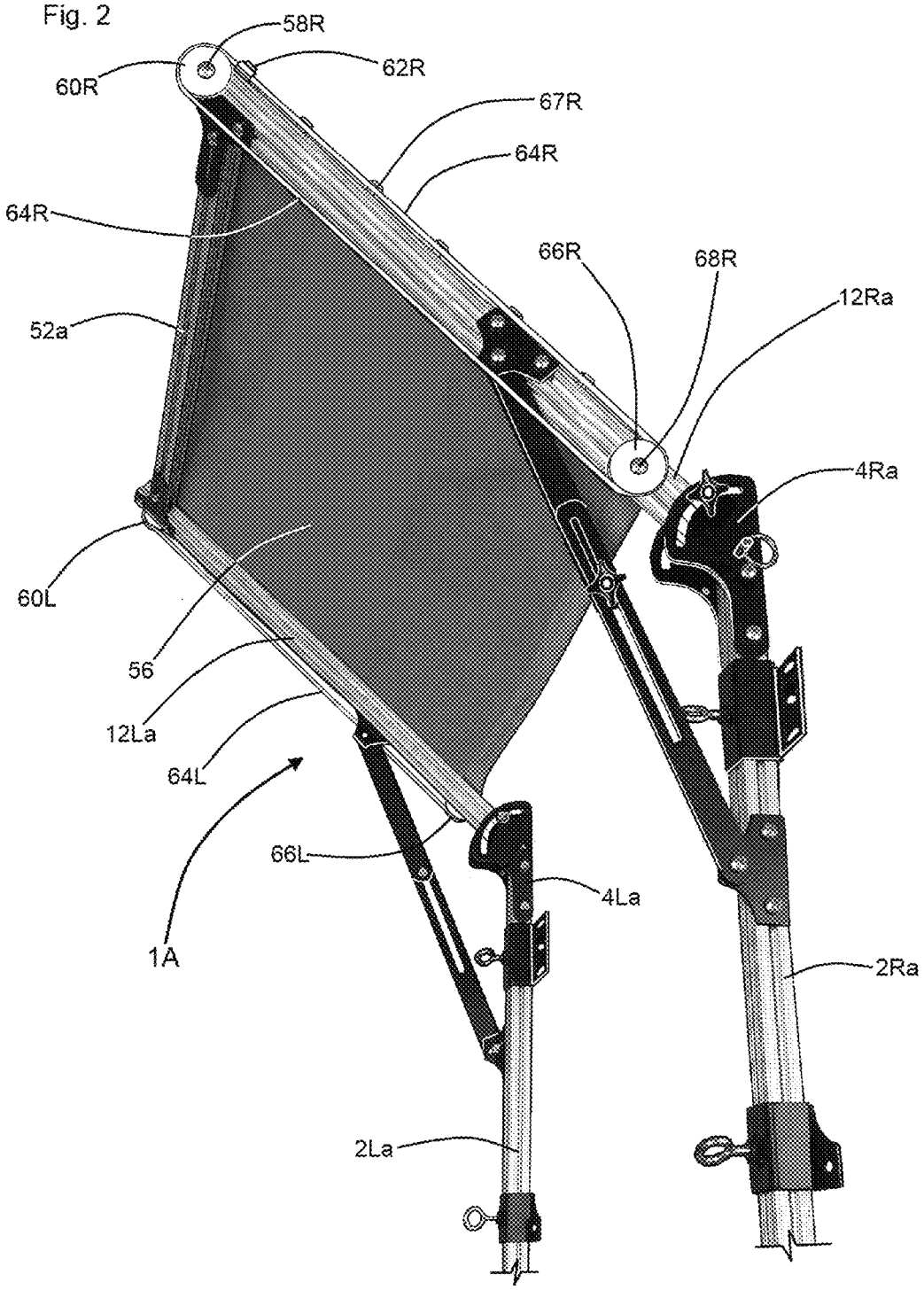

FIG. 2 presents an alternate configuration of the modular awning assembly of FIG. 1.

Figure 3:
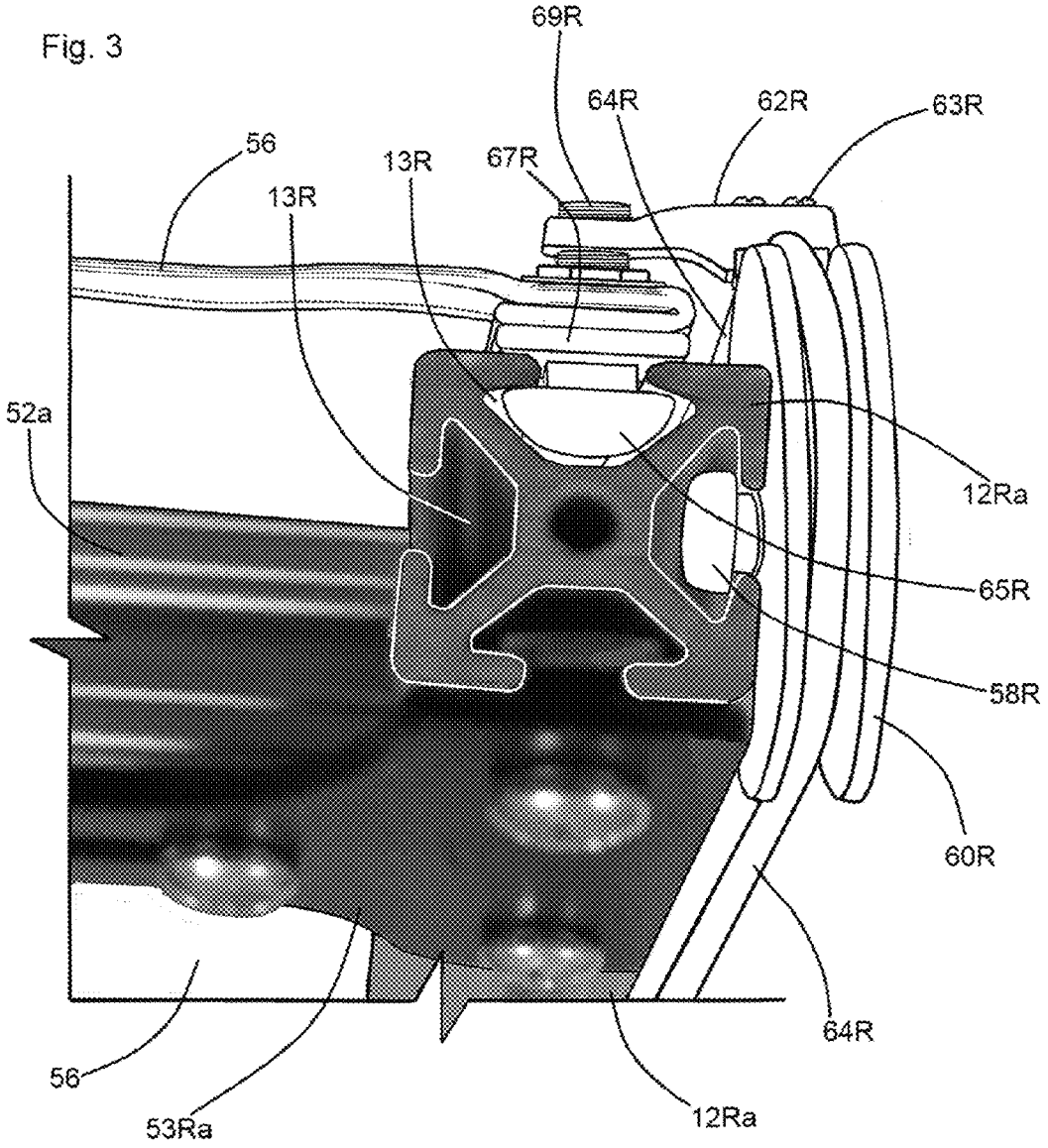

FIG. 3 is a partial end view of the shade frame component of the modular awning assembly of FIG. 2.

Figure 4:
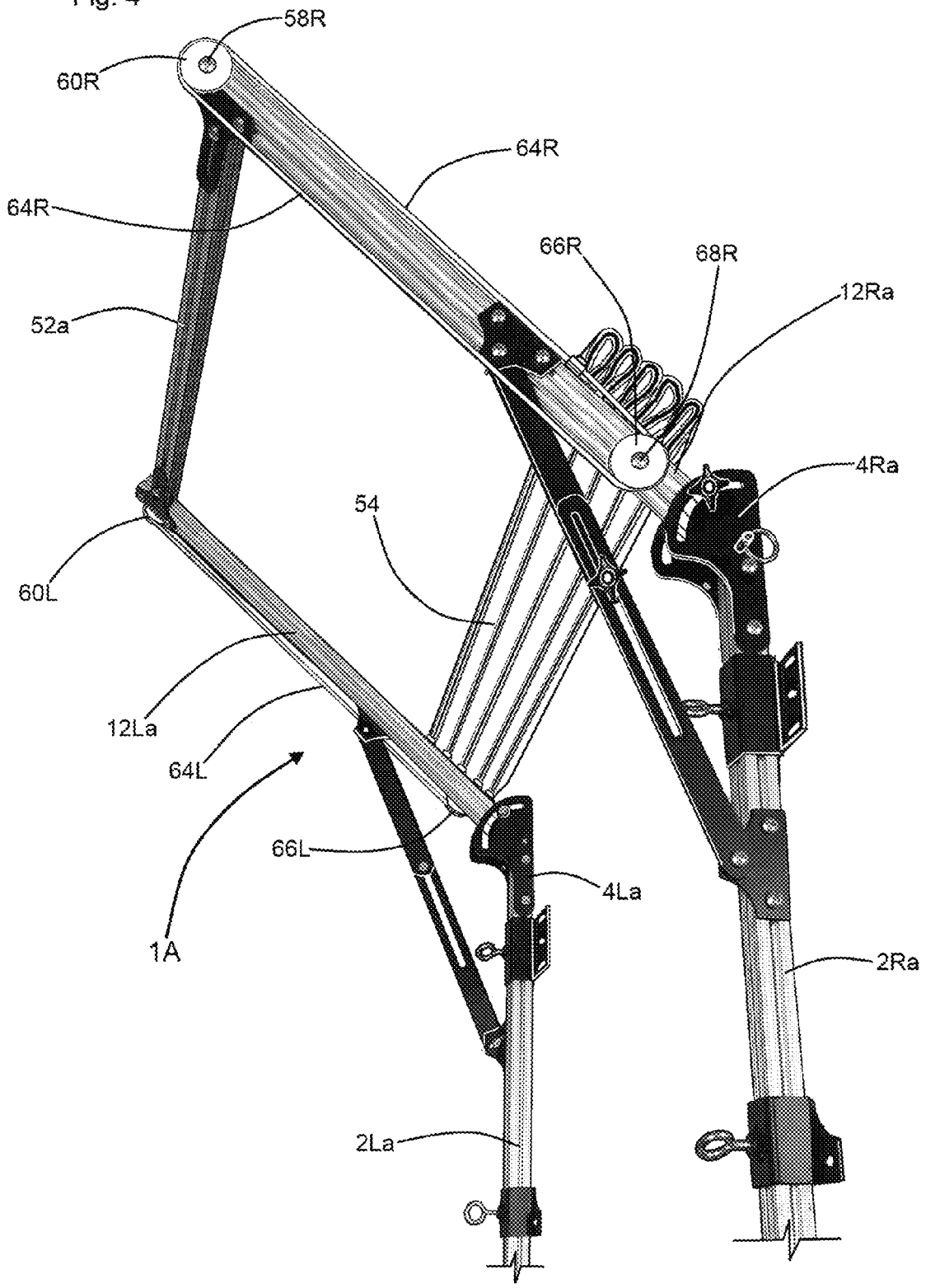

FIG. 4 redepicts the modular awning assembly of FIG. 2, the view of FIG. 4 showing the awning's flexible sheet component moved to a retracted or reefed configuration.

DETAILED DESCRIPTION OF PREFERRED EMBODIMENTS

Referring now to the drawings, and in particular to Drawing FIG. 1, a preferred embodiment of the instant inventive modular awning assembly is referred to generally by Reference Arrow 1. The assembly 1 preferably comprises a left vertical support column 2L and right vertical support column 2R. In their preferred embodiments, the left and right vertical support columns 2L and 2R are composed of extruded aluminum bar or beam stock, such extrusions preferably presenting, referring further simultaneously to FIG. 3, an array of outwardly opening slide/lock channels similar to channels 13R.

The instant inventive modular awning assembly 1 preferably further comprises a shade/support frame which preferably incorporates left and right arms 12L and 12R, and a crossbeam 52 spanning between such arms' distal ends. Similarly with the preferred configurations of the vertical support columns 2L and 2R, arms 12L and 12R and crossbeam 52 preferably comprise extruded aluminum bar stock. Channel engaging and clamping joint fasteners 50L and 50R are preferably provided for engaging such beam's and arms' slide/lock channels and for rigidly interconnecting the left and right ends of crossbeam 52 with the distal ends of arms 12L and 12R. A flexible sheet 54 which is preferably composed of durable vinyl coated polyester fabric or a woven synthetic fiber fabric is provided, such sheet being preferably fixedly attached to and overlying frame members 12L, 12R, and 52.

First attaching means are preferably provided for pivotally attaching the proximal ends of the shade frame's arms 12L and 12R to the upper ends of the vertical support columns 2L and 2R. In a preferred embodiment, the first attaching means comprise left and right clevis joints 4L and 4R which present curved angular positioning slots 8L and 8R. Hinge pins 6L and 6R extend laterally between the leaves of the clevises 4L and 4R, such hinge pins being received within pin receiving eyes (not depicted within views) and being received with aligned pin receiving eyes extending laterally through the extreme proximal ends of arms 12L and 12R. Turn screw assemblies 10L and 10R alternatively compress against and release the laterally outer surfaces of the clevises 4L and 4R, such turn screws facilitating selective joint tightening and joint loosening facilitating selective angular positioning and repositioning of the frame 12L, 12R, 52, and the flexible sheet 54. The clevis joint assemblies 4L and 4R depicted are intended as being representative of other commonly known joints which are capable of facilitating selective angular positioning of interconnected parts.

Referring further to FIG. 1, the instant inventive awning assembly 1 preferably further comprises a first, and preferably first and second, or left and right triangulating braces 14L, 16L, and 14R, 16R. The braces are preferably adapted for telescoping movements and for selective locking and releasing actions at selected extended or retracted positions by means of slide slot and compression screw combinations 18L, 20L, and 18R, 20R. Such combinations 18L, 20L and 18R, 20R are representative of other commonly known lockable telescoping arm configurations such as lockable quill and shaft combinations.

Proximal and distal ends of the triangulating braces 14L, 16L, and 14R, 16R are preferably respectively fixedly attached to arms 12L and 12R and to vertical support columns 2L and 2R by means of pivoting "T" joints 22L, 22R, 24L, 24R, such joints being attached via locking engagements with the arms' and columns' slide/lock channels. In operation, counter-clockwise turning of turn screws 20L, 20R, 10L and 10R converts the triangulating braces 14L, 16L and 14R, 16R, the arms 12L and 12R, and the vertical support columns 2L and 2R into a relatively freely movable and positionable three bar linkage. Upon freeing such linkage, the shade frame 12L, 12R, 52, and flexible sheet 54 may be advantageously pivotably moved to various angularly cantilevered positions with respect to the vertical support columns 2L and 2R. Clockwise re-tightening of such turn screws advantageously fixes the shade frame and flexible sheet 54 in place at a desired repositioned orientation.

Referring further to FIG. 1, second attaching means adapted for fixedly and variably attaching the assembly 1 to structures such as vehicles, boats, buildings, and fences are preferably provided. In the preferred embodiment depicted in FIG. 1, such second attaching means comprise a plurality of slide sleeves 26L, 26R, 40L, and 40R, which incorporate laterally extending mounting plates 28L, 28R, 42L, and 42R. Such mounting plates are preferably adapted to include screw or bolt receiving eyes 44L, 44R and/or attachment strap receiving slots 30L and 30R. By providing combinations of such eyes and slots, fasteners such as screws, bolts, and attachment straps may be selectively used for achieving secure attachments of the assembly 1 to variously configured objects and structures. The second attaching means' sleeves 26L, 26R, 40L, and 40R preferably incorporate manually turnable set screws 32L, 32R, 46L, and 46R, such set screw and sleeve combinations allowing for selective slidable positioning and repositioning of the shading components of the assembly 1 with respect to support columns 2L and 2R and with respect to a structure to which such columns are attached.

Referring simultaneously to all figures, structures depicted in FIGS. 2-4 which are identified by a Reference Numeral having the suffix "a" are configured substantially identically with similarly numbered structures appearing in FIG. 1. In the alternate configuration 1A of the instant inventive modular awning assembly, a retractable or reefable flexible sheet 56 is alternatively movably deployed upon frame members 12La, 12Ra, and 52*a*. Left and right pairs of pulleys 60L, 66L, and 60R, 66R are rotatably mounted upon the laterally outer aspects of arms 12La and 12Ra by channel mounted journal axles 58R and 60R (the journal axles mounting pulleys 60L and 66L not being within views). Continuous loop pull cords 64L and 64R respectively operatively interconnect the pulleys 60L, 66L, and 60R, 66R. Along the rightward edge of the flexible sheet 56, a series of sheet edge clamping slide fasteners 67R interconnect the sheet 56 with arm 12Ra, such connections constituting sliding mounts which connect with slide blocks 65R within slide channel 13R. A distal-most slide fastener 67R preferably includes an upward extension 69R for helical thread adjustable mounting upon a cord clamping fastener 62R, 63R. Fastener 62R, 63R requires that the distal end of the sheet 56 move in unison with the pulley guided motion of pull cord 64R. Similar sheet fasteners interconnect the leftward edge of sheet 56 with pull cord 64L and with the slide channel of arm 12La.

In operation of the assembly 1A depicted in FIGS. 2-4, upon simultaneous proximally directed pulls exerted against the lower flights of pull cords 64L and 64R, flexible sheet 56 may be distally drawn to the extended shading configuration depicted in FIG. 2. Opposite distally directed pulls against cords 64L and 64R oppositely retracts the flexible sheet 54 to the reefed or accordion folded configuration depicted in FIG. 4.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A modular awning assembly comprising:

(a) a flexible sheet comprising vinyl coated polyester fabric or a woven synthetic fiber;

(b) a shade frame fitted for supporting the flexible sheet, the shade frame comprising left and right arms having proximal and distal ends, the shade frame further comprising at least a first cross beam spanning between the left and right arms;

(c) left and right slide channel and slide block combinations, said combinations' slide channels opening at the left and right arms, and said combinations' slide blocks being fixedly attached to the flexible sheet;

(d) left and right pulley and draw cord combinations operatively interconnecting the flexible sheet and the left and right arms, said combination being adapted for alternatively distally and proximally moving the flexible sheet along the left and right arms;

(e) left and right vertical support columns;

(f) shade attaching means respectively pivotally connecting the proximal ends of the shade frame's left and right arms to the left and right vertical support columns;

(g) left and right sleeve and mounting plate combinations fitted for slidably receiving the left and right vertical support columns, said combinations being adapted for releasably attaching the left and right vertical support columns to a structure selected from the group consisting of vehicles, recreational vehicle side walls, vehicle hitches, boats, boat deck rails, building side walls, and fences; and (h) left and right set screws connected operatively to the left and right sleeve and mounting plate combinations for releasably locking the left and right vertical support columns at a selected elevation with respect to the left and right sleeve and mounting plate combinations.

2. The modular awning assembly of claim 1 wherein the shade attaching means comprise left and right triangulating braces respectively operatively spanning between the left arm and support column and between the right arm and support column.

3. The modular awning assembly of claim 2 further comprising a plurality of slide channels, each channel among the plurality of slide channels opening at one of the columns among the left and right vertical support columns, or opening at one of the arms among the left and right arms.

4. The modular awning assembly of claim 3 wherein each triangulating brace has an end attached in sliding engagement with one of the slide channels.

5. The modular awning assembly of claim 4 wherein the shade attaching means further comprise left and right clevis joints, the shade attaching means' pivotal connections comprising said clevis joints.

6. The modular awning assembly of claim 5 further comprising left and right pin and alignable eyes combinations operatively incorporated within the left and right clevis joints, the left and right pin and alignable eyes combinations being adapted for releasably locking the shade frame at a selected angular extension from the vertical support columns.

* * * * *